US008844907B1

(12) United States Patent
Davis et al.

(10) Patent No.: US 8,844,907 B1
(45) Date of Patent: Sep. 30, 2014

(54) FENCE/RAILING POST CAP SYSTEM

(76) Inventors: James E. Davis, Woodbine, MD (US); Peter V. Stewart, Gaithersburg, MD (US)

( * ) Notice: Subject to any disclaimer, the term of this patent is extended or adjusted under 35 U.S.C. 154(b) by 390 days.

(21) Appl. No.: 12/660,542

(22) Filed: Mar. 1, 2010

Related U.S. Application Data

(60) Provisional application No. 61/209,659, filed on Mar. 10, 2009.

(51) Int. Cl.
*E04H 17/00* (2006.01)

(52) U.S. Cl.
USPC ..... 256/1; 256/19; 403/326; 403/329

(58) Field of Classification Search
CPC ... E04H 2017/006; E04H 17/14; E04H 17/20; E04H 12/003; E04H 12/22; E04H 12/2253; E04H 12/32; E04H 13/001
USPC ..... 256/1, 19; 403/326, 329; 24/293, 295; 220/475; 248/314
See application file for complete search history.

(56) References Cited

U.S. PATENT DOCUMENTS 1,214,319 A * 1/1917 Kennedy et al. ..... 52/38
1,337,222 A * 4/1920 Harned ..... 362/502
1,765,140 A * 6/1930 Fitl ..... 47/41.01
2,210,441 A * 8/1940 Bachman ..... 52/297
3,498,576 A * 3/1970 Alissandratos ..... 211/107
3,587,520 A * 6/1971 Miller ..... 116/173
3,818,868 A * 6/1974 Boehland, Jr. ..... 119/431
4,014,520 A * 3/1977 Walters ..... 256/22
4,609,185 A * 9/1986 Prater et al. ..... 256/65.11
4,722,514 A * 2/1988 Pettit ..... 256/50
D299,821 S * 2/1989 Dively ..... D13/139.5
4,821,454 A * 4/1989 Wilds ..... 47/41.01
5,199,213 A * 4/1993 Krebs et al. ..... 47/39
5,285,748 A * 2/1994 Weldin ..... 119/57.9
5,332,196 A * 7/1994 Wright ..... 256/47
5,409,190 A * 4/1995 Mattox ..... 248/315
5,421,556 A * 6/1995 Dodge et al. ..... 256/1
5,685,343 A * 11/1997 Smith ..... 138/89
5,709,057 A * 1/1998 Johnson et al. ..... 52/301
5,711,433 A * 1/1998 Smith ..... 211/71.01
5,853,167 A * 12/1998 West et al. ..... 256/19
6,076,807 A * 6/2000 Spence ..... 256/1
6,138,422 A * 10/2000 Wall et al. ..... 52/300
D434,001 S * 11/2000 Sayger ..... D13/139.5
6,513,284 B1 * 2/2003 Sandlin ..... 47/66.6
6,554,012 B2 * 4/2003 Patarra ..... 135/16
6,581,335 B2 * 6/2003 Grant ..... 52/28
6,742,748 B1 * 6/2004 Gretz ..... 248/156
6,755,394 B2 * 6/2004 Forbis et al. ..... 256/65.01
6,893,008 B2 * 5/2005 Forbis ..... 256/65.05
D509,603 S * 9/2005 Rosian ..... D25/135
D509,915 S * 9/2005 Rosian ..... D25/135
D509,916 S * 9/2005 Rosian ..... D25/135

(Continued)

*Primary Examiner* — Joshua Kennedy
*Assistant Examiner* — Matthew R McMahon
(74) *Attorney, Agent, or Firm* — Berenato & White, LLC

(57) ABSTRACT

A fence/railing post cap system for use with a fence/railing post includes a decorative and utilitarian structure which enables removal and storage of a cap of the system to accommodate reception of beverage containers and the like within a base of the system and which provides for a pole with accessory structures therein to be mounted on the base by passing through an opening in the cap when the cap is in position on the base.

1 Claim, 10 Drawing Sheets

(56) References Cited

U.S. PATENT DOCUMENTS

| | | | | |
|---|---|---|---|---|
| D513,781 | S * | 1/2006 | Clary | D22/147 |
| 7,017,517 | B2 * | 3/2006 | Paquette | 119/51.01 |
| 7,143,556 | B2 * | 12/2006 | Hales | 52/301 |
| 7,267,324 | B2 * | 9/2007 | Young | 256/65.02 |
| 7,278,240 | B2 * | 10/2007 | Burkart et al. | 52/155 |
| D567,965 | S * | 4/2008 | Deverson | D25/135 |
| D580,581 | S * | 11/2008 | Grant | D26/68 |
| 7,637,470 | B2 * | 12/2009 | Siu | 248/519 |
| 7,938,376 | B2 * | 5/2011 | Jimenez et al. | 248/316.7 |
| 8,091,578 | B2 * | 1/2012 | Roth et al. | 403/326 |
| 8,136,296 | B2 * | 3/2012 | Hogan | 47/83 |
| 2002/0104985 | A1 * | 8/2002 | Lesenskyj | 256/65.1 |
| 2002/0125468 | A1 * | 9/2002 | Fischer | 256/19 |
| 2003/0122115 | A1 * | 7/2003 | Ernst et al. | 256/1 |
| 2003/0182876 | A1 * | 10/2003 | Landers | 52/101 |
| 2005/0039377 | A1 * | 2/2005 | Clary | 43/54.1 |
| 2005/0102923 | A1 * | 5/2005 | Oidtman | 52/155 |
| 2007/0180784 | A1 * | 8/2007 | Smith | 52/300 |
| 2008/0149791 | A1 * | 6/2008 | Bradley | 248/220.21 |
| 2009/0100789 | A1 * | 4/2009 | Hornbeak et al. | 52/745.19 |
| 2011/0253960 | A1 * | 10/2011 | Robinson | 256/1 |

* cited by examiner

FENCE/RAILING POST CAP SYSTEM

CROSS-REFERENCE TO RELATED APPLICATION

This application claims the benefit of U.S. provisional patent application Ser. No. 61/209,659, filed Mar. 10, 2009.

BACKGROUND OF THE INVENTION

Residential decks require a railing system, which includes railing posts. The caps for the posts have traditionally been strictly ornamental, or in some rare cases, include a light fixture. Fence/railing post cap system described herein, turn the ornamental post cap into a useful element.

An object of the present invention is to provide for removal of the cap from the post and for storage of the cap in a vertical position to expose a cup or a bottle holder.

Another object is to provide such a system wherein the cap has a hole in the top of the cap that is plugged by a decorative plug/ornament that hides the hole when the cap is being used simply as a cap or cover for the post.

A further object of the invention is the provision of a walled extension projecting normally downwardly which acts as a pole holder.

A still further object of the invention is to provide an accessory structure mounted on the top end of the pole such as a party tray, serving bowl, chip/dip tray, birdbath, birdhouse, birdfeeder, flower pot, etc.

Another object is to provide such a system which is both ornamental and functional.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

BRIEF SUMMARY OF THE INVENTION

To achieve these and other objects, the present invention provides a fence/railing post cap system for mounting on the top of a fence/railing post, the post having a predetermined cross-section and a hollow cavity therein, the system comprising: a base defining a bottom member for positioning onto the fence post top and at least one side wall extending normally upwardly from the bottom member to form an interior hollow space; the bottom member defining a walled extension projecting normally downwardly, the extension defining a closed lower end and an open upper end opening into the interior hollow space; a plurality of leg members extending normally downwardly from the base; means in operative relationship with the leg members for holding the base in predetermined relationship with the post; and a cap sized and configured for removable positioning onto the base.

BRIEF DESCRIPTION OF THE SEVERAL VIEWS OF THE DRAWINGS

The accompanying drawings, which are incorporated in and constitute a part of this specification, illustrate preferred embodiments of the invention and, together with the description, serve to explain the principles of the invention.

DETAILED DESCRIPTION OF THE INVENTION

Figure 2:
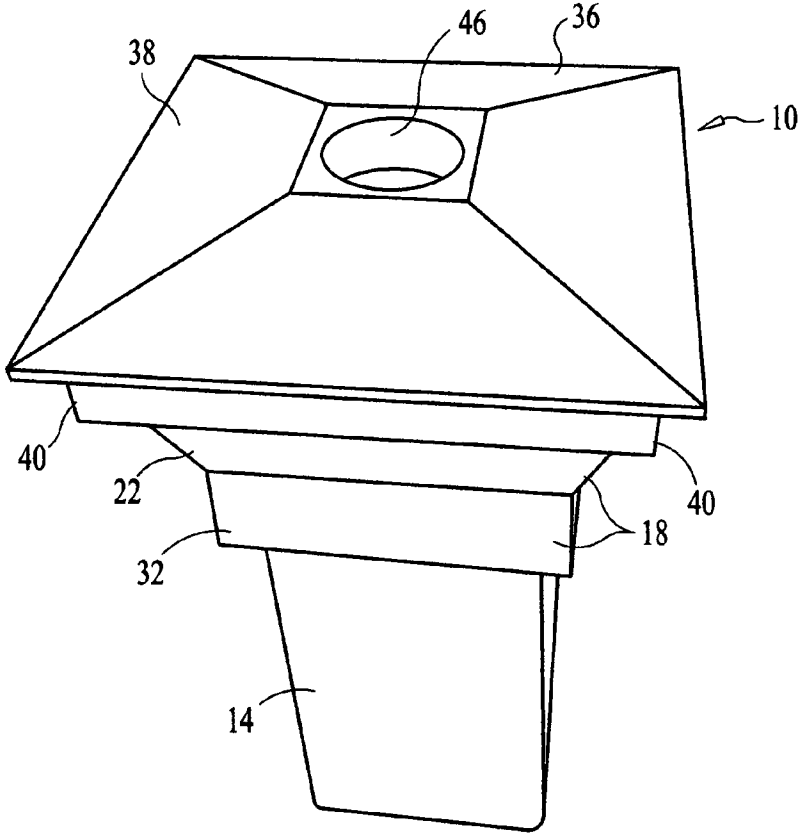
FIG. 2 is a perspective view showing the system of FIG. 1 but with the closure element on the cap removed to show a centrally located opening within the cap.
Figure 1:
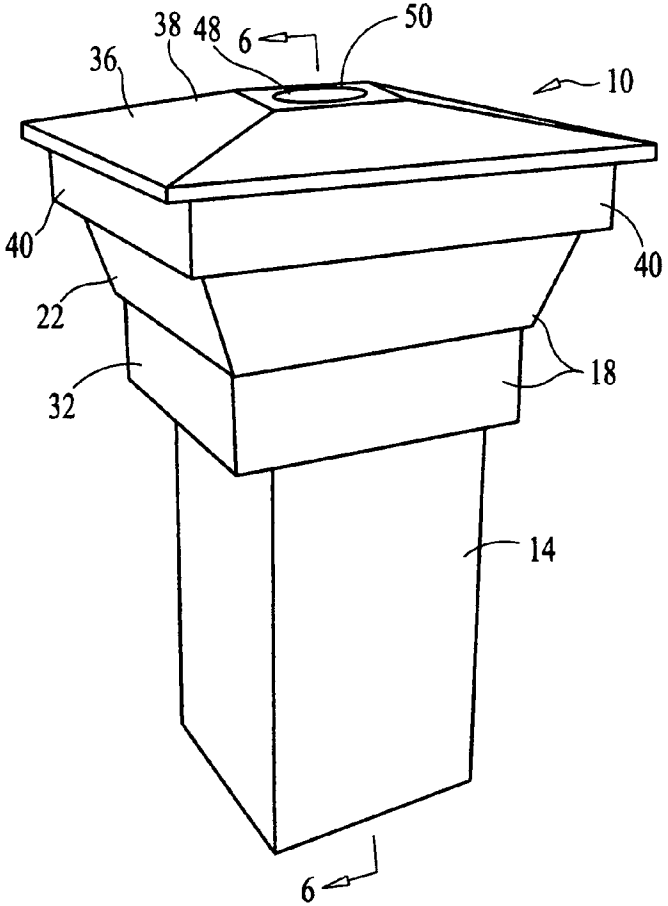
FIG. 1 is a perspective view showing the post cap system of this invention mounted onto a fence/railing post.

With reference now to the drawings, wherein like reference characters designate like or corresponding parts throughout the several views, there is shown a fence/railing post cap system 10 for mounting onto the top 12 of a fence/railing post 14, wherein post 14 has a predetermined cross-section and a hollow cavity 16 therein.

System 10 includes a base 18 which defines a bottom member 20 for positioning onto fence post top 12. See FIG. 6. Base 18 defines at least one side wall 22 extending normally upwardly from bottom member 20 to form an interior hollow space 24.

Bottom member 20 defines a hollow walled extension 26 projecting normally downwardly, and extension 26 defines a closed lower end 28 and an open upper end 30 opening into interior hollow space 24. Space 24 and extension 26 are dimensioned to enable a conventional beverage container to be placed within space 24 and to rest on bottom member 20 without falling into extension 26.

A plurality of leg members 32 or 32' extend normally downwardly from base 18, and means 34 or 34' are provided in operative relationship with leg members 32 or 32' for holding base 18 in predetermined relationship with post 14.

A cap 36 or 36' is sized and configured for removable positioning onto base 18.

Cap 36 includes a top 38 and at least one rim 40 extending normally downwardly from top 38, and rim 40 defines a plurality of inwardly facing protuberances 42. A side wall 22 of base 18 defines a plurality of outwardly facing concave dimples 44, and protuberances 42 and dimples 44 are sized, configured and positioned for enabling protuberances 42 to snap-fit into dimples 44 for holding cap 36 in position on base 18.

In accordance with one embodiment of the invention, cap top 38 defines a centrally located opening 46 therein. A closure element 48 is sized and configured for removable positioning within centrally located opening 46. Closure element 48 includes a decorative plug 50 and a nut 52 which threadably engages plug 50 to retain the plug in position within centrally located opening 46. A second invention embodiment provides a cap 36' without a centrally located opening therein, and another embodiment eliminates hollow walled extension 26.

System 10 further includes a pole 54 having a bottom end 56 and a top end 58. Pole 54 is sized and configured for removable positioning through centrally located opening 46 when closure element 48 has been removed from opening 46 and for positioning within and support by walled extension 26. An accessory structure 60 is mounted on top end 58 of pole 54.

Post 14 typically has a conventional substantially square cross-section, and base 18 preferably defines four side walls 22 orthogonally connected together. Likewise, leg members 32, 32' are preferably four in number and are orthogonally connected together.

Post 14 has a plurality of openings 62 within sides of post 14, and holding means 34 include a plurality of projections 64 extending inwardly from leg members 32 for engaging post openings 62 to hold base 18 in fixed relationship with post 14. See FIGS. 6 and 8.

Figure 7:
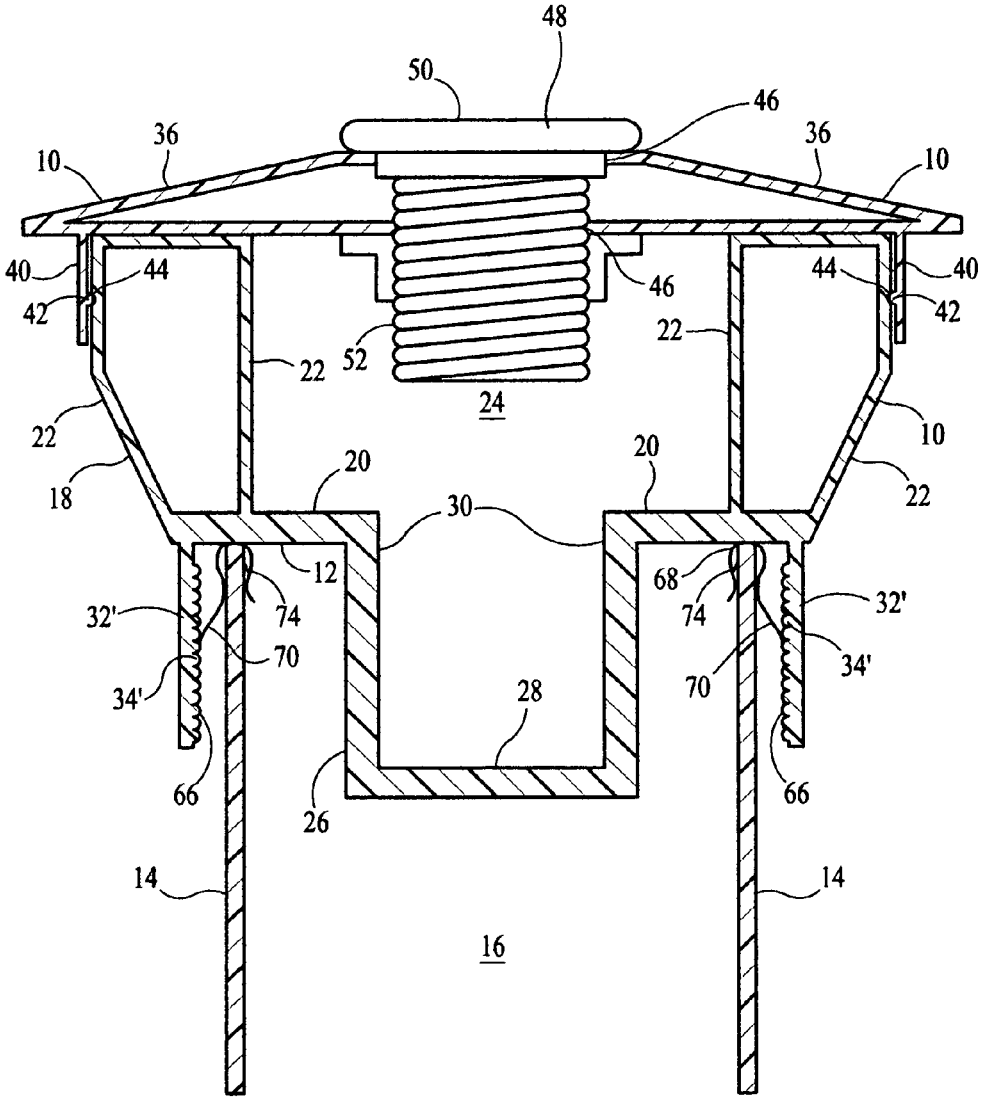
FIG. 7 is a view as shown in FIG. 6 but showing an alternative structure for holding the base in predetermined relationship with the fence/railing post.
Figure 10:
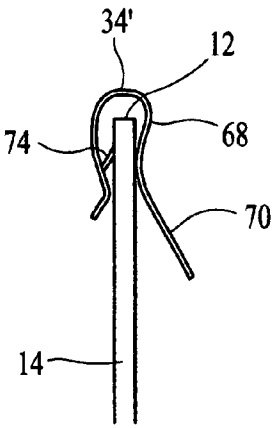
FIG. 10 is a detailed diagrammatic view showing the embodiment of a structure for holding the base in predetermined relationship with the fence/railing post, as shown in FIG. 7.
Figure 9:
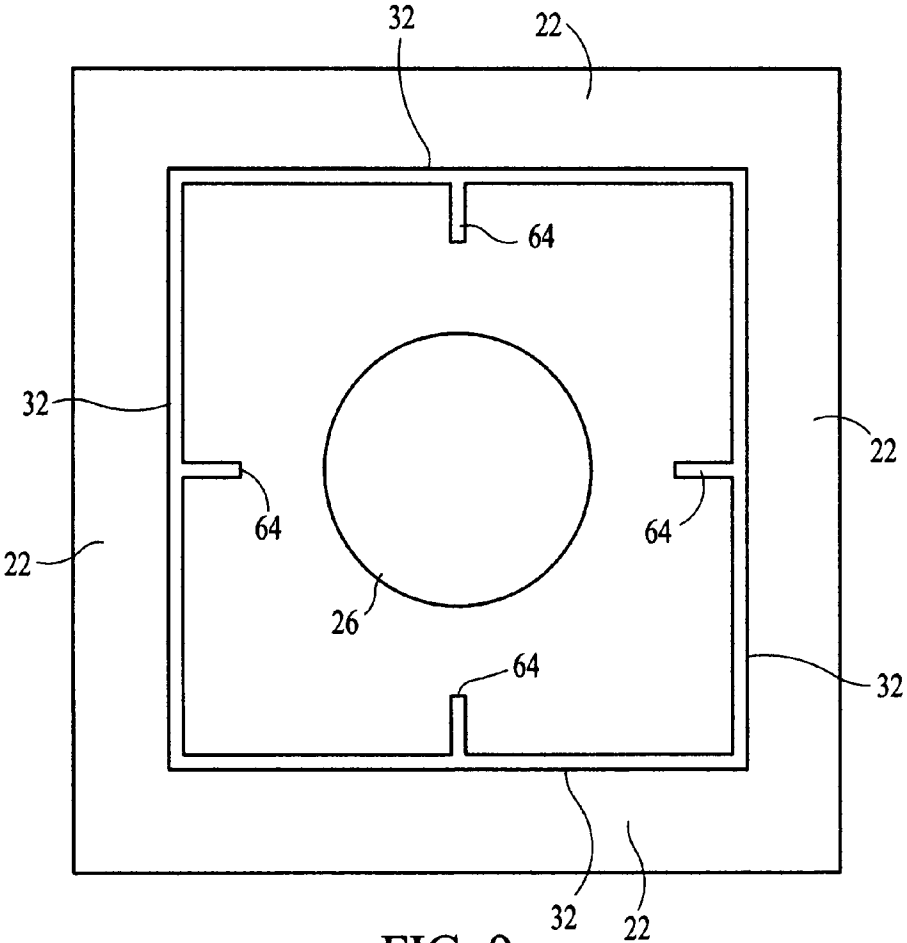
FIG. 9 is a bottom plan view of the system shown in FIG. 6 but with the cap removed from the base.
Figure 11:
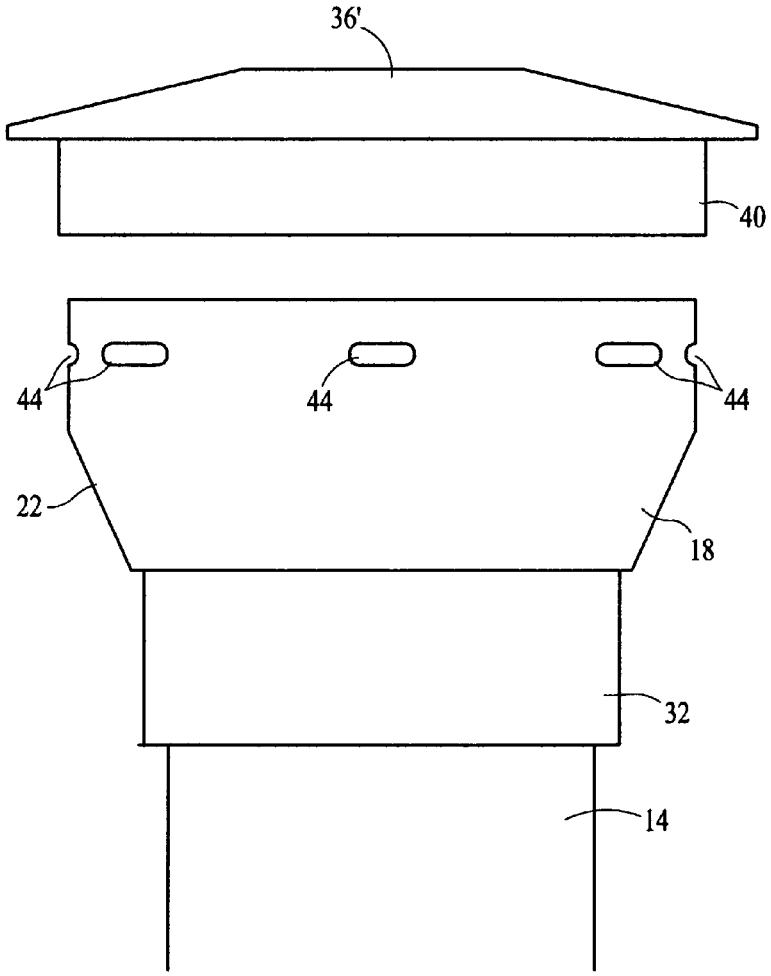
FIG. 11 is a front elevation view of an alternative configuration of the system wherein the cap is not provided with a centrally located opening therein and wherein the cap is positioned above the base prior to being placed onto the base.

When fence/railing post 14 is a hollow, open-topped post, holding means 34' include a plurality of normally substantially horizontal alternating ridges and grooves 66 positioned inwardly on leg members 32 and a plurality of spring loaded clips 68 fixedly pressed onto tops 12 of post walls 14 with their spring loaded action, clips 68 each having a barb 74 that bites into the interior of the post wall to hold the clips in place and make it very difficult to remove. Each clip 68 also has a tongue 70 extending normally downwardly at a slight angle for engaging ridges and grooves 66 to hold base 18 in fixed position with respect to post 14. See FIGS. 7 and 10.

Figure 12:
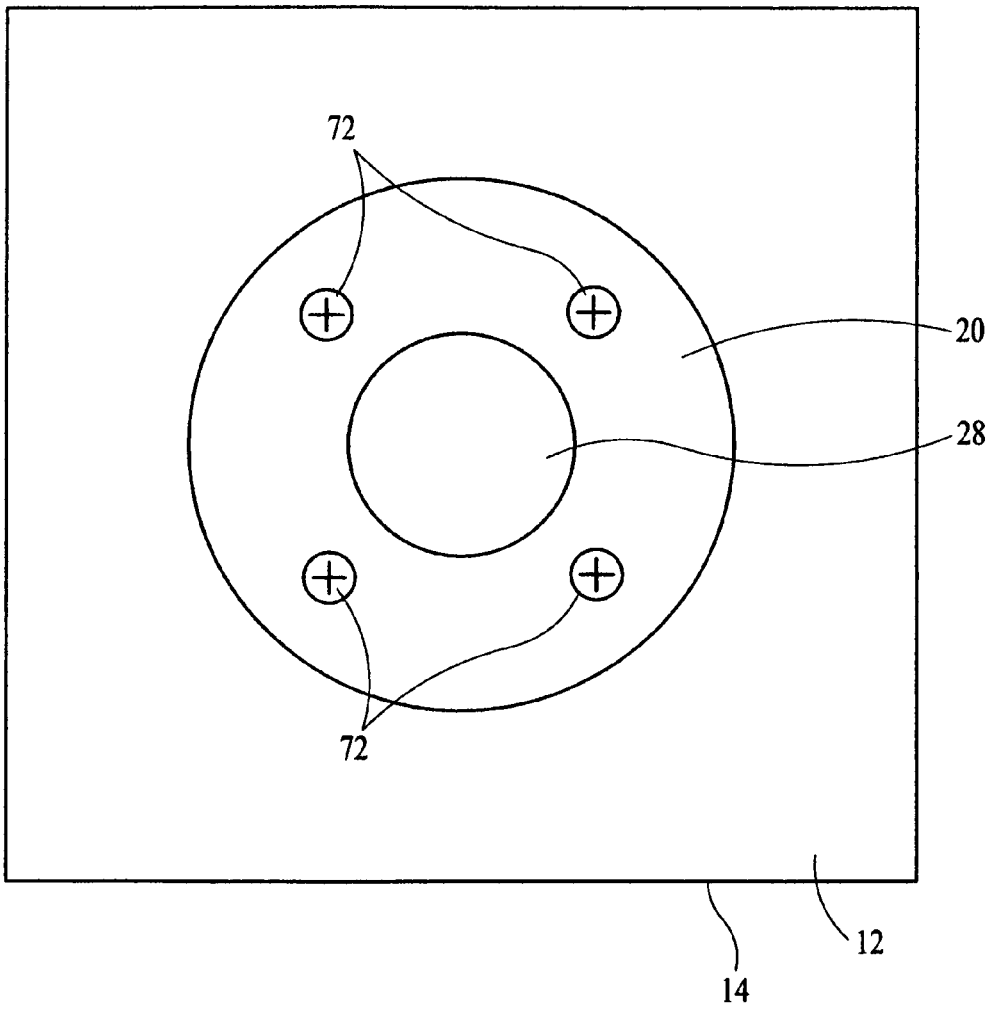
FIG. 12 is a top plan view of the system mounted on the top of a solid fence/railing post and with the cap removed.

If post 14 is a solid post, such as a wood post, system 10 includes a plurality of fastening members 72, such as screws, for connecting base 18 to post top 12. See FIG. 12.

In use, base 18 is typically installed on either an existing hollow pvc sleeve type post or a solid wooden post. On the pvc installation, the installer would find the center point of each of the four sides of the pvc post 14. The installer would then measure down a predetermined distance from top 12 edge of post 14 and then drill a hole 62 of predetermined size. Projections 64 on legs 32 would snap into drilled holes or openings 62 to hold base 18 in fixed position on post 14 without use of any other hardware.

An alternative method of installation on an existing pvc sleeve type post would be to provide legs 32' without projections 64 but with a plurality of normally substantially horizontal alternating ridges and grooves 66 positioned inwardly on each leg member 32'. Four spring loaded clips 68 would be pressed onto the top of the four sides of the pvc post with their spring loaded action. Barbs 74 would bite into the pvc post interior to further hold clip 68 in place and make it very difficult to remove. The outside of each clip 68 would contain a metal tongue 70 protruding downwardly at a slight angle. The downwardly protruding metal tongue 70 would engage the inside of leg member 32' as base 18 is pressed downwardly onto post 14, and tongue 70 would engage ridges and grooves 66 to firmly hold base 18 in place on top of post 14.

Another alternative method of installation of base 18 would be to manufacture leg members 32 without having projections 64. In this configuration, the installer would simply screw through the four sides of the leg members 32 to fasten them to the sides of post 14 once base 18 is positioned onto the top 12 of post 14.

Figure 6:
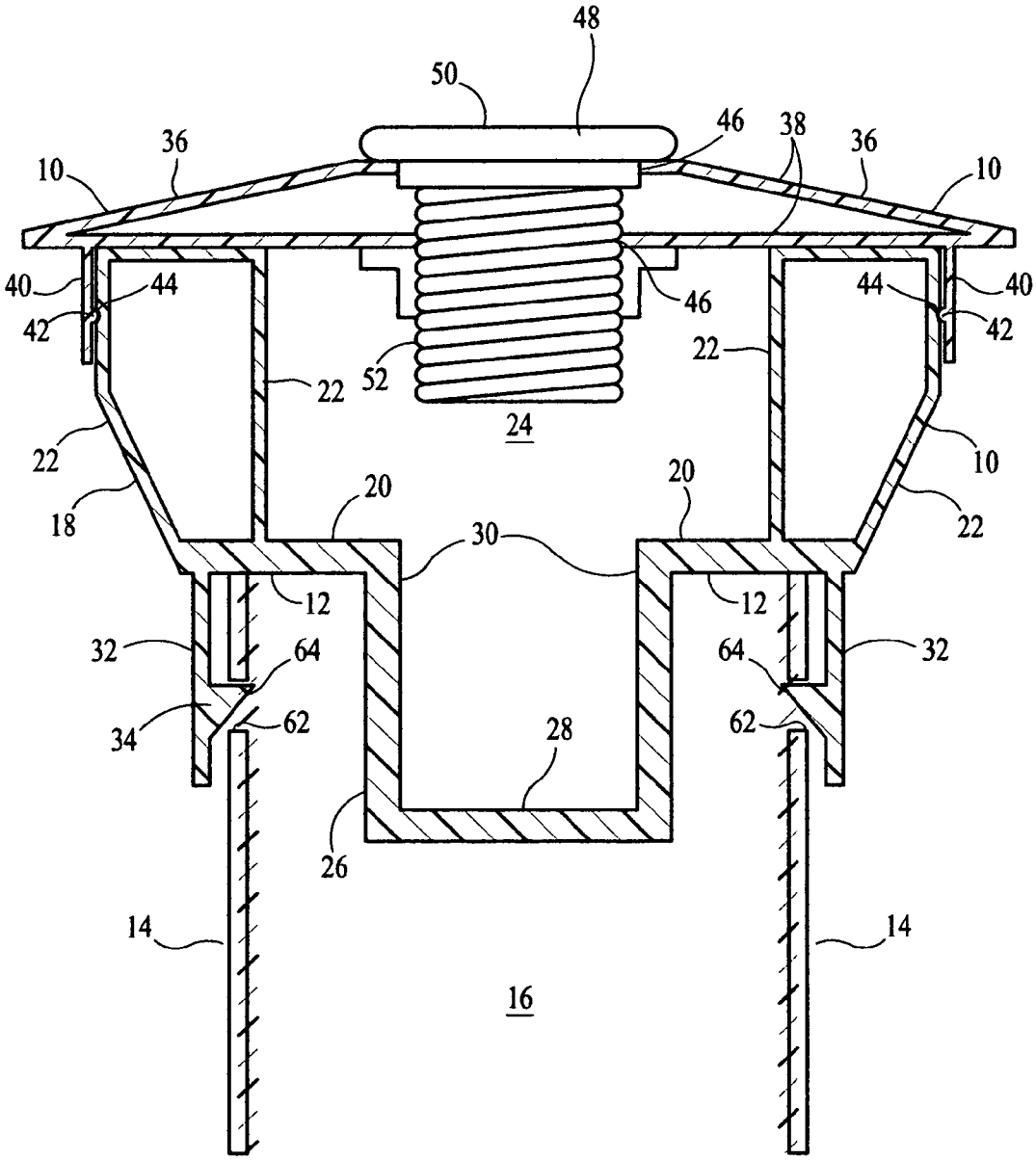
FIG. 6 is a cross-sectional view of the system shown in FIG. 1 taken along the line 6-6 in FIG. 1 and looking in the direction of the arrows.

If the embodiment shown in FIG. 6 is to be installed on a solid post made of wood or other material, a circular hole is drilled into the center of top 12 of post 14 a predetermined depth. The circular hole should be dimensioned to receive extension 26. Projections 64 would then act as spacers between leg members 32 and the sides of wood post 14 to insure that base 18 is centered on the post. Base 18 is fastened to the top of wood post 14, preferably with stainless steel wood screws 72 installed through bottom member 20 of base 18 and into top 12 of wood post 14. See FIG. 12.

Each of caps 36, 36' has a plurality of protuberances 42 on the inside of rims 40. Matching concave dimples 44 on side wall 22 of base 18 allow caps 36, 36' to be firmly held in place on top of base 18 by snapping protuberances 42 into dimples 44. This will hold caps 36, 36' in position on base 18 but will allow caps 36, 36' to be removed from base 18 when it is desired to use base 18 as a cup holder by positioning the cup or other object into interior hollow space 24 of base 18 to rest on bottom member 20.

When caps 36, 36' are removed from base 18, the protuberances/dimple system will allow the caps to hang off one side of base 18 in a vertical position to allow for storage of the caps while base 18 is in use as a cup holder. This is accomplished by snap fitting protuberances 42 into corresponding dimples 44, as shown in FIG. 13.

Figure 3:
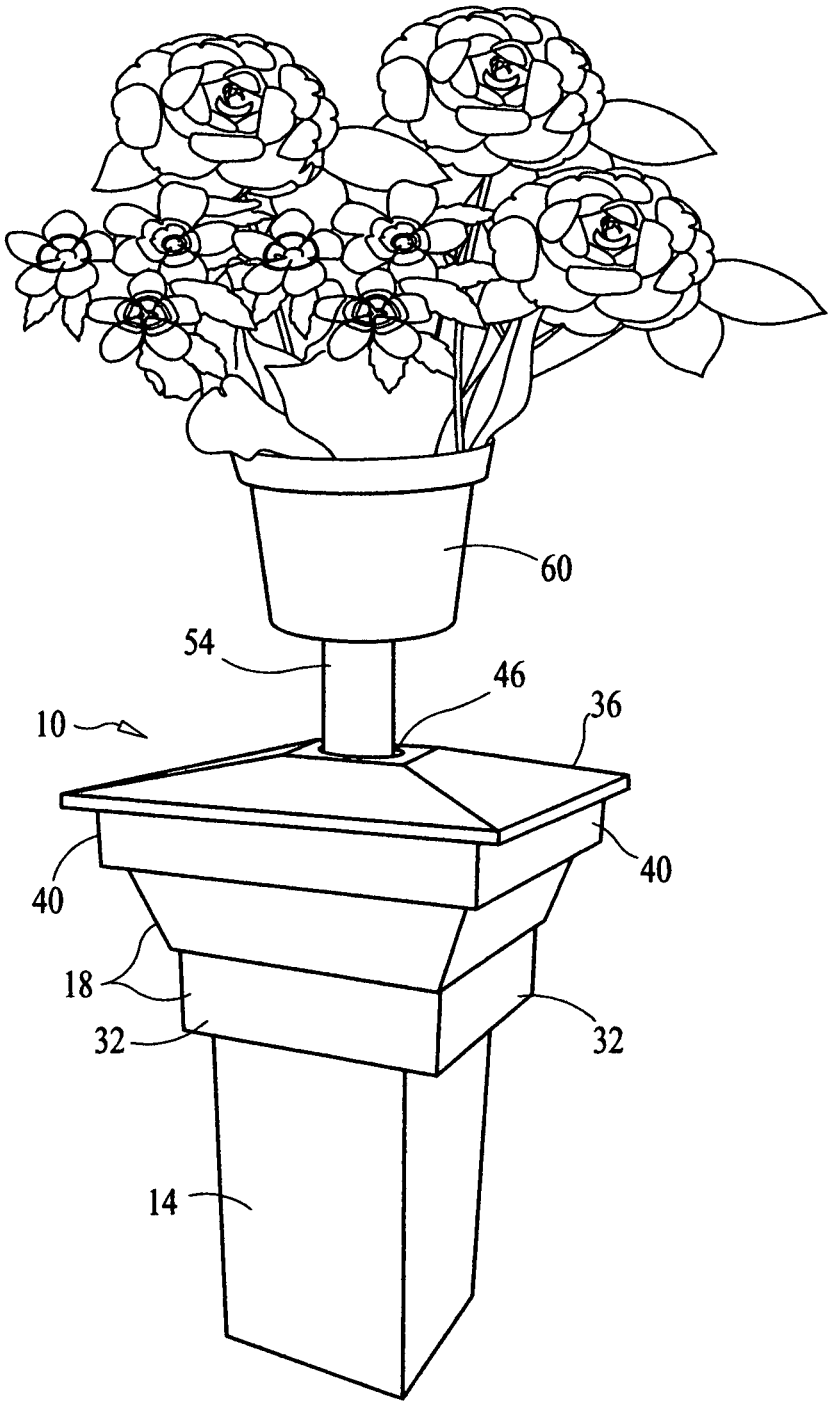
FIG. 3 is a perspective view of the fence/railing post cap system showing a pole removably positioned through the centrally located opening within the cap and further showing an accessory structure mounted on the top end of the pole, which accessory structure in this illustration is a flower pot with flowers therein.
Figure 8:
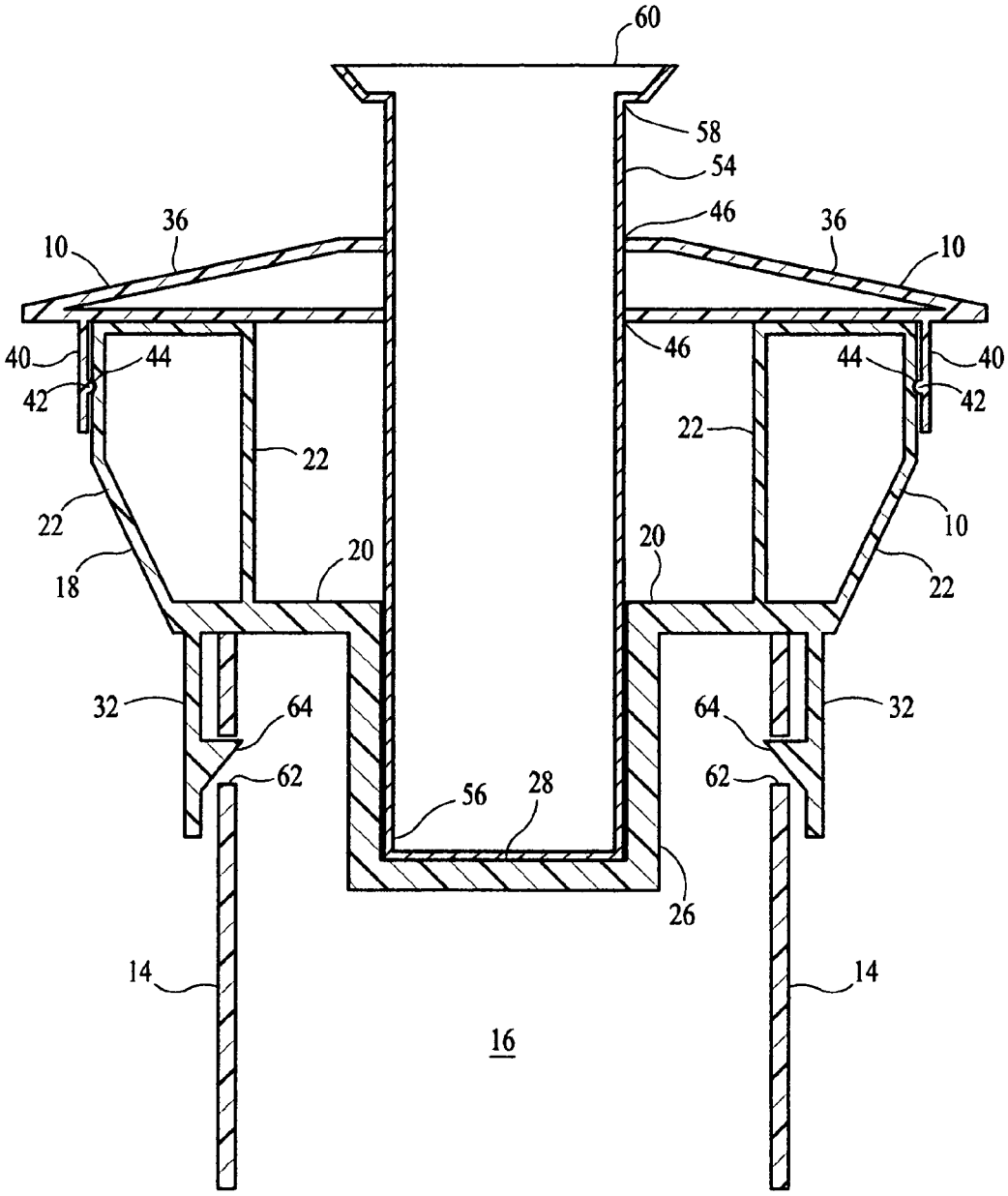
FIG. 8 is a view as shown in FIG. 6 but showing the cap closure element removed and showing a pole positioned within the base and extending upwardly through the centrally located opening within the cap.

When it is desired to use pole 54 and accessory structure 60, cap 36 with centrally located opening 46 therein is snap fit into position onto base 18. Closure element 48 will have previously been removed by first removing nut 52 from the threaded portion of closure element 48, and pole 54 with accessory structure 60 attached thereto can be lowered through opening 46 and positioned and supported within walled extension 26. This configuration is illustrated in FIGS. 3 and 8.

Figure 13:
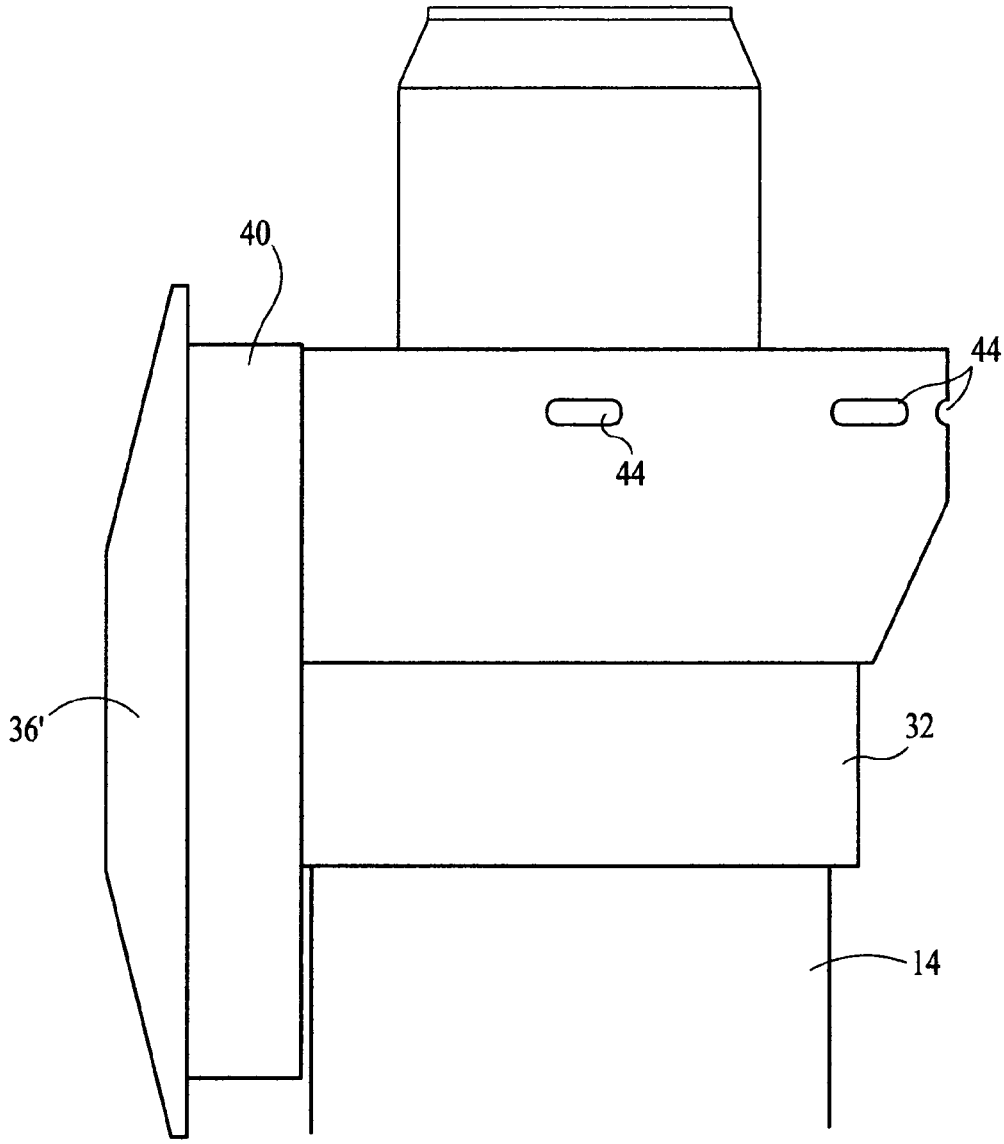
FIG. 13 is a front elevation view of the fence/railing post cap system showing the cap attached to the base in a vertically stored position and further showing a beverage can positioned within the base.

Pole 54 can also be positioned within extension 26 with cap 36 or 36' removed from base 18 and placed in the stored position shown in FIG. 13.

Figure 5:
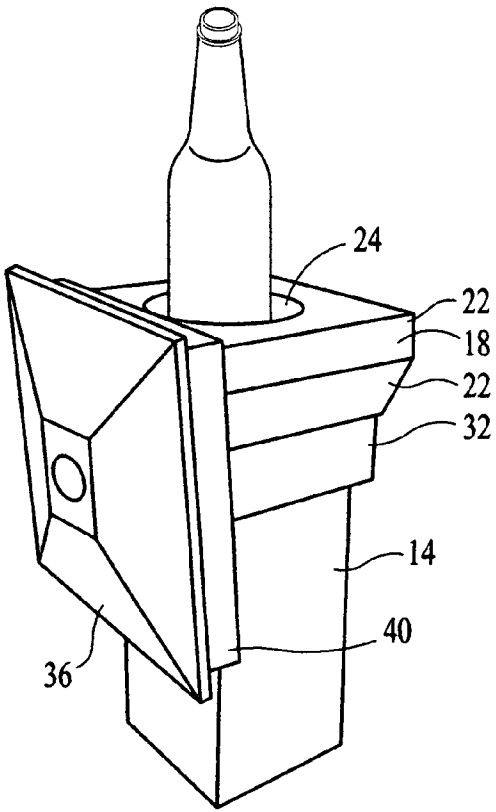
FIG. 5 is a perspective view of the system showing the cap attached to the base in a vertically stored position and showing a bottle positioned within the base.
Figure 4:
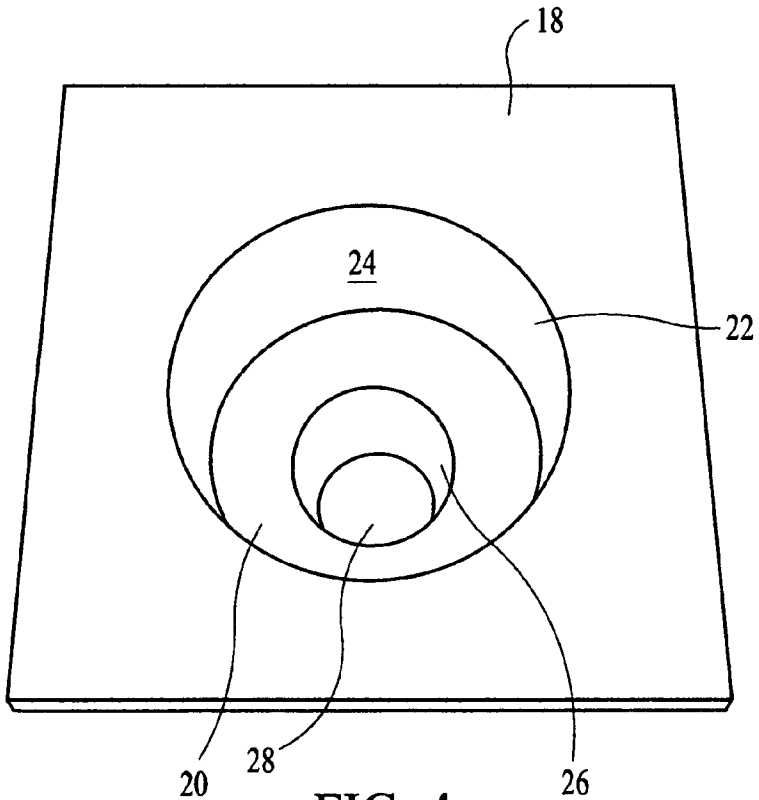
FIG. 4 is a top perspective view of the fence/railing post cap system with the cap removed.

This invention provides for a unique fence/railing post cap system which is both decorative and utilitarian. When caps 36, 36' are removed from base 18, as shown in FIGS. 5 and 13, beverage or other types of containers can be positioned within interior hollow space 24 in base 18 and will rest on bottom member 20. Because of the dimensions of base 18, typical beverage and other containers are large enough to rest on bottom 20 without falling into wall extension 26. However, pole 54 is dimensioned to fit within walled extension 26 and to fit through opening 46 in cap 36 as shown in FIGS. 3 and 8.

The invention in its broader aspects is not limited to the specific details shown and described, and departures may be made from such details without departing from the principles of the invention and without sacrificing its chief advantages.

What is claimed is:

1. A fence/railing post cap system for mounting onto the top of a fence/railing post, said post having a predetermined cross-section and a hollow cavity therein, said system comprising:

a base defining a bottom member for positioning onto said post top and at least one side wall extending normally upwardly from said bottom member to form an interior hollow space;

said bottom member defining a walled extension projecting normally downwardly and away from said interior hollow space, said extension defining a lower end and an open upper end opening into said interior hollow space;

a plurality of leg members extending normally downwardly from said base;

holding means in operative relationship with said leg members for holding said base in predetermined relationship with said post;

a cap sized and configured for removable positioning onto said base;

wherein said cap includes;

a top and at least one rim extending normally downwardly from said top, said rim defining a plurality of inwardly facing protuberances;

wherein said at least one base side wall defines a plurality of outwardly facing concave dimples;

said protuberances and said dimples sized, configured and positioned for enabling said protuberances to snap-fit into said dimples for holding said cap in position on said base;

wherein said cap top defines a centrally located opening passing through said top of the cap; and further including a closure element removably positioned within said centrally located opening to completely close said centrally located opening and to provide access to said interior hollow space upon removal of said closure element, and wherein said centrally located opening is aligned with said walled extension which projects downwardly and away from said centrally located opening, wherein said holding means include a plurality of normally substantially horizontal alternating ridges and grooves positioned inwardly on said leg members; and a plurality of spring loaded clips to be fixedly positioned on top of walls of said post, said clips each having a tongue extending normally downwardly at a slight angle for engaging said ridges and grooves to hold said base in fixed position with respect to said post.

* * * * *